US010928172B1

(12) United States Patent
Mironski

(10) Patent No.: US 10,928,172 B1
(45) Date of Patent: Feb. 23, 2021

(54) ADJUSTABLE TACTICAL CARRIER

(71) Applicant: Tomasz Boguslaw Mironski, Cameron, NC (US)

(72) Inventor: Tomasz Boguslaw Mironski, Cameron, NC (US)

( * ) Notice: Subject to any disclaimer, the term of this patent is extended or adjusted under 35 U.S.C. 154(b) by 0 days.

(21) Appl. No.: 16/714,013

(22) Filed: Dec. 13, 2019

(51) Int. Cl.
*F42B 39/02* (2006.01)

(52) U.S. Cl.
CPC ..... *F42B 39/02* (2013.01)

(58) Field of Classification Search
CPC .... F41A 9/83; F41A 9/65; F42B 39/02; F42B 39/26; A45F 5/02; A45F 2200/0591
See application file for complete search history.

(56) References Cited

U.S. PATENT DOCUMENTS

| | | | | |
|---|---|---|---|---|
| 5,484,093 | A | 1/1996 | Hellweg et al. | |
| 5,894,976 | A | 4/1999 | Harper | |
| 6,154,997 | A | 12/2000 | Aluotto et al. | |
| 6,668,479 | B1 | 12/2003 | Obong | |
| 7,637,048 | B2 | 12/2009 | Tal et al. | |
| 8,485,405 | B2 | 7/2013 | Crye | |
| 9,194,679 | B2 * | 11/2015 | Orozco | F42B 39/02 |
| 9,212,859 | B1 | 12/2015 | Tal et al. | |
| 9,394,080 | B2 | 7/2016 | Beck | |
| 9,668,568 | B2 | 6/2017 | Evans | |
| 9,746,299 | B1 | 8/2017 | Davis | |
| 9,759,536 | B2 | 9/2017 | Gadams et al. | |
| 10,306,973 | B2 * | 6/2019 | Evans | A45F 5/02 |
| 10,352,652 | B2 * | 7/2019 | Higdon, Jr. | F41C 33/0236 |
| 10,571,220 | B2 * | 2/2020 | Toschi | F41C 33/04 |
| 2003/0052147 | A1 | 3/2003 | Hughes et al. | |
| 2004/0159036 | A1 | 8/2004 | Newman | |
| 2007/0278269 | A1 | 12/2007 | Rogers et al. | |
| 2008/0277436 | A1 | 11/2008 | Wilson | |
| 2010/0176173 | A1 | 7/2010 | Felts | |
| 2014/0109455 | A1 | 4/2014 | Chiang | |
| 2016/0003598 | A1 * | 1/2016 | Gadams | F42B 39/02 206/3 |
| 2016/0209163 | A1 * | 7/2016 | VanHeusen | A45F 5/00 |

* cited by examiner

*Primary Examiner* — Corey N Skurdal
(74) *Attorney, Agent, or Firm* — Dunlap Bennett & Ludwig, PLLC; Brendan E. Squire

(57) ABSTRACT

An adjustable tactical carrier facilitates the carriage of a variety of differently shaped tactical items. The tactical carrier includes an internal frame defining a base and a sidewall of a carrier compartment. The internal frame is adjustable between a compressed position and an extended position. A fabric pouch is dimensioned to at least partially surround the internal frame. The fabric pouch has a plurality of slots defined in a spaced apart relation about the fabric pouch, preferably in a MOLLE configuration. A cinch cord is laced through the plurality of slots, such that the cinch cord may be tensioned to draw the fabric pouch in a close fitting relation with the internal frame in each of the compressed position and the extended position.

14 Claims, 7 Drawing Sheets

ADJUSTABLE TACTICAL CARRIER

BACKGROUND OF THE INVENTION

The present invention relates to firearm magazines and, more particularly, to carriers for firearm magazines.

A firearm owner will typically obtain a plurality of magazines for their firearm. When the firearm owner desires to shoot the firearm, such as at a range, they may have a magazine carrier, or pouch, that is worn on their body so that they may conveniently carry the plurality of magazines in the event they desire to change magazines while shooting.

Many firearm owners may own more than one magazine fed firearm. Where the caliber or style of the firearm varies, the dimensions of a magazine for one firearm will vary from the dimensions of the magazine for another firearm. Consequently, the firearm owner will need to purchase a variety of magazine carriers.

In a tactical situation, carriers are also desirable for other tactical items such as radios, optics, illumination devices, navigational aids, and other small items. Many of these tactical items may have customized carriers that may not be amenable to a desired tactical loading configuration and are suitable for only carrying the item for which it was designed.

While other carriers on the market may be adjustable, they generally require non-user friendly adjustment methods, are limited in their capacity, or place a dependence on a single element of the design to perform multiple functions in extremely hazardous environments.

As can be seen, there is a need for an improved tactical carrier that may be readily adjusted to accommodate differently sized magazines or other tactical items of varying dimensions such as rifle magazines or radios.

SUMMARY OF THE INVENTION

In one aspect of the present invention, an adjustable tactical carrier is disclosed to accommodate a variety of tactical items of differing dimensions. The tactical carrier includes an internal frame defining a base and a sidewall of a carrier compartment. The internal frame is adjustable between a compressed position and an extended position. An eye loop may be defined at a top end of the internal frame. A fabric pouch is dimensioned to at least partially surround the internal frame. The fabric pouch has a plurality of slots defined in a spaced apart relation about the fabric pouch. A cinch cord is laced through the eye loop and the plurality of slots, such that the cinch cord may be tensioned to draw the fabric pouch in a close fitting relation with the internal frame.

In some embodiments, a cinch clamp receives a free end of the cinch cord there through. The cinch clamp is configured to retain the cinch cord in a selected tension about the tactical carrier.

In some embodiments, a first frame member and a second frame member are formed in a generally L-shape and are adjustably interconnected between a base plate and a top plate. A base element of each of the first frame member and the second frame member is adjustably carried between a top plate and a base plate. A slotted guide aperture is defined in the base element of each of the first frame member and the second frame member. A fastener extends through the slotted guide aperture and secures the top plate and the base plate.

In other embodiments, a lock bore is defined in the base plate. A lock aperture is defined in the base element and a lock stud extends through the lock aperture and the lock aperture. A lock knob is adapted to threadingly engage the lock stud to retain the first frame member and the second frame in a selected displacement between the compressed position and the extended position.

In a preferred embodiment, the plurality of slots are adapted to a Modular Lightweight Load-carrying Equipment (MOLLE) configuration.

In other aspects of the invention, an adjustable tactical carrier includes an internal frame defining a base and a sidewall of a carrier compartment. The internal frame adjustable between a compressed position and an extended position. A fabric pouch is dimensioned to at least partially surround the internal frame. The fabric pouch has a plurality of slots defined in a spaced apart relation about the fabric pouch. A cinch cord may be laced through the plurality of slots, wherein the cinch cord may be tensioned to draw the fabric pouch in a close fitting relation with the internal frame in each of the compressed position and the extended position.

In other embodiments, a cinch clamp receives a free end of the cinch cord there through. The cinch clamp is configured to retain the cinch cord in a selected tension about the fabric pouch.

In other embodiments, a first frame member and a second frame member are formed in a generally L-shape configuration that are adjustably interconnected between a base plate and a top plate. A base element of each of the first frame member and the second frame member is adjustably carried between the top plate and the base plate. A slotted guide aperture may be defined in the base element of one of the first frame member and the second frame member. A fastener extends through the slotted guide aperture and secures the top plate and the base plate.

In other embodiments, a lock bore is defined in the base plate, a lock aperture is defined in the base element, and a lock stud extends through the lock aperture and the lock aperture. A lock knob is adapted to cooperatively engage the lock stud to retain the first frame member and the second frame in a selected displacement between the compressed position and the extended position.

In yet other embodiments, the adjustable tactical carrier includes a belt clip threadingly secured to the tactical carrier via the cinch cord.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved tactical carrier that is user adjustable to accommodate a variety of tactical items, such as ammunition magazines, optics, illumination devices, medical items, communications devices, grenades, and navigational aids.

Figure 1:
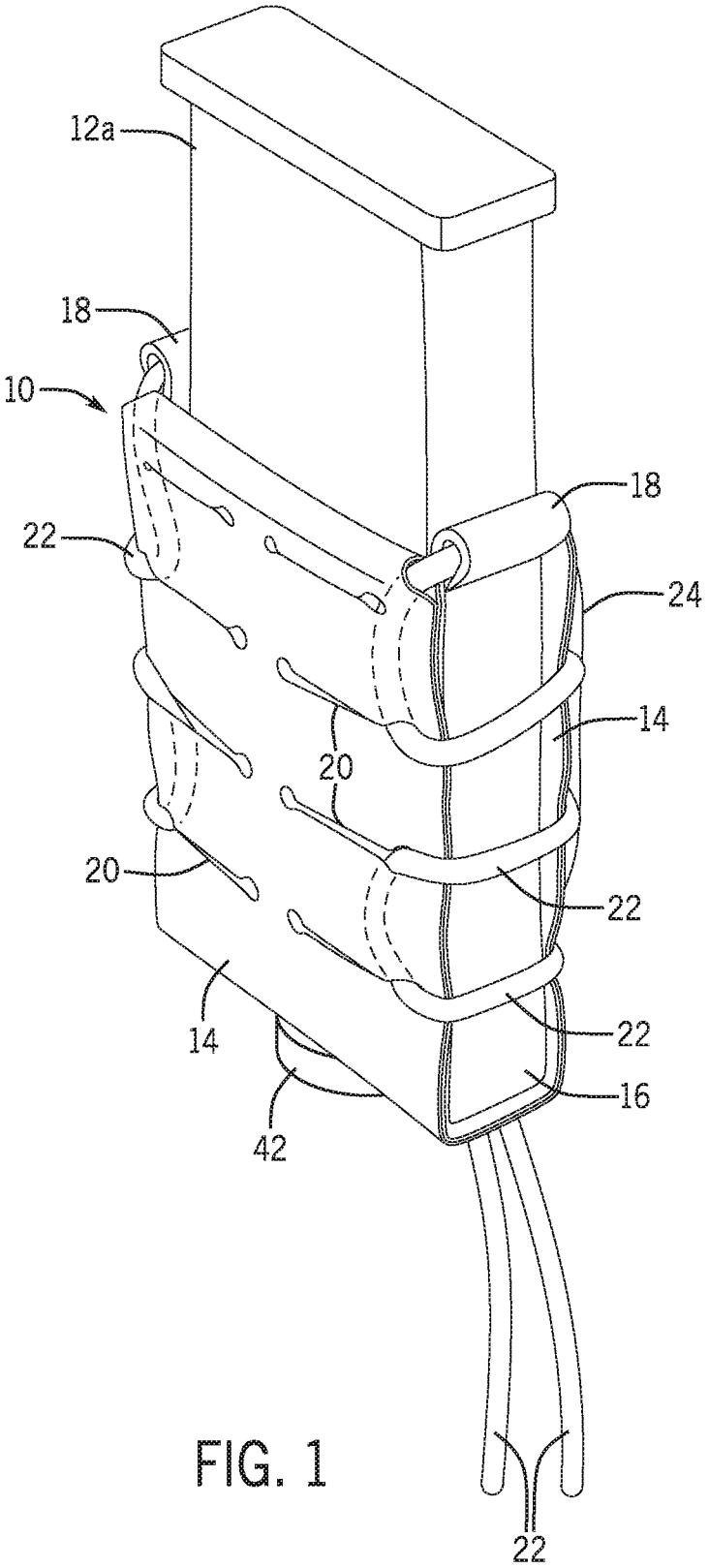
FIG. 1 is a front perspective view of the tactical carrier shown in use holding an ammunition magazine.
Figure 3:
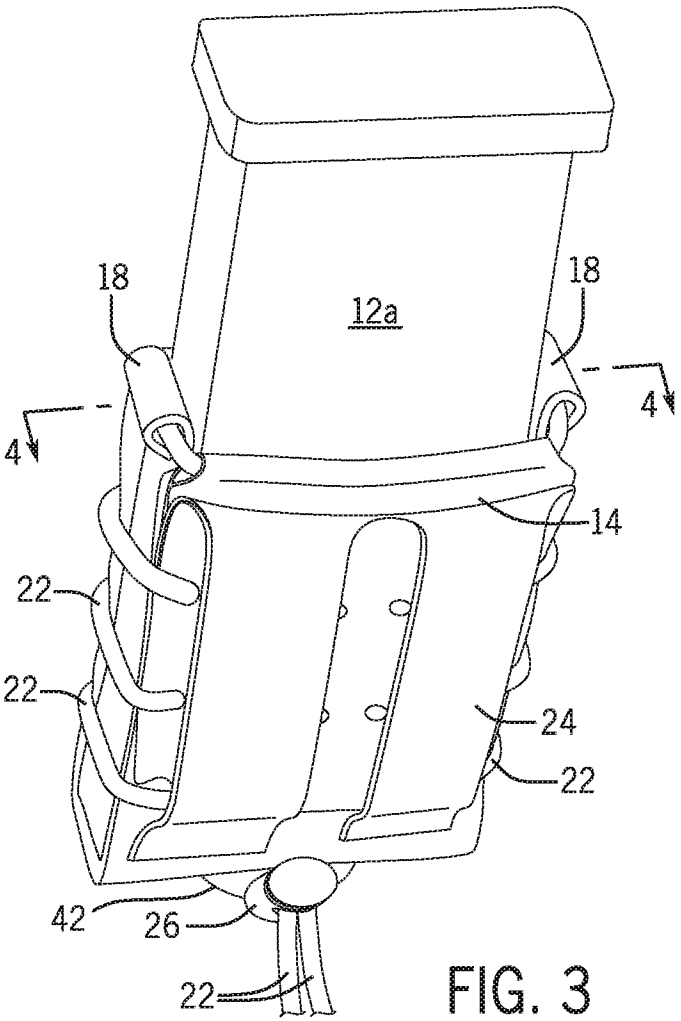
FIG. 3 is a rear perspective view of the tactical carrier.

In reference to FIG. 1, the adjustable tactical carrier 10 is shown carrying a first size ammunition magazine 12*a*. The tactical carrier 10 includes an outer fabric pouch 14 that is partially wrapped about an internal frame 16 forming a lateral sidewall of the tactical carrier 10. A loop 18 is defined at a top end of the internal frame 16. A plurality of slots 20 are defined in a surface of the fabric pouch 14. The plurality of slots 20 are disposed in a spaced apart relation and are adapted to attach the tactical carrier 10 to Modular Lightweight Load-carrying Equipment (MOLLE) via a strap. A cinch cord 22 is laced through the plurality of slots 20, the loop 18, and an optional belt clip 24. The cinch cord 22 along with the fabric pouch 14 and the internal frame 16 provide for adjustment of the tactical carrier 10 to accommodate the variety of tactical items that may be carried therein.

Figure 2:
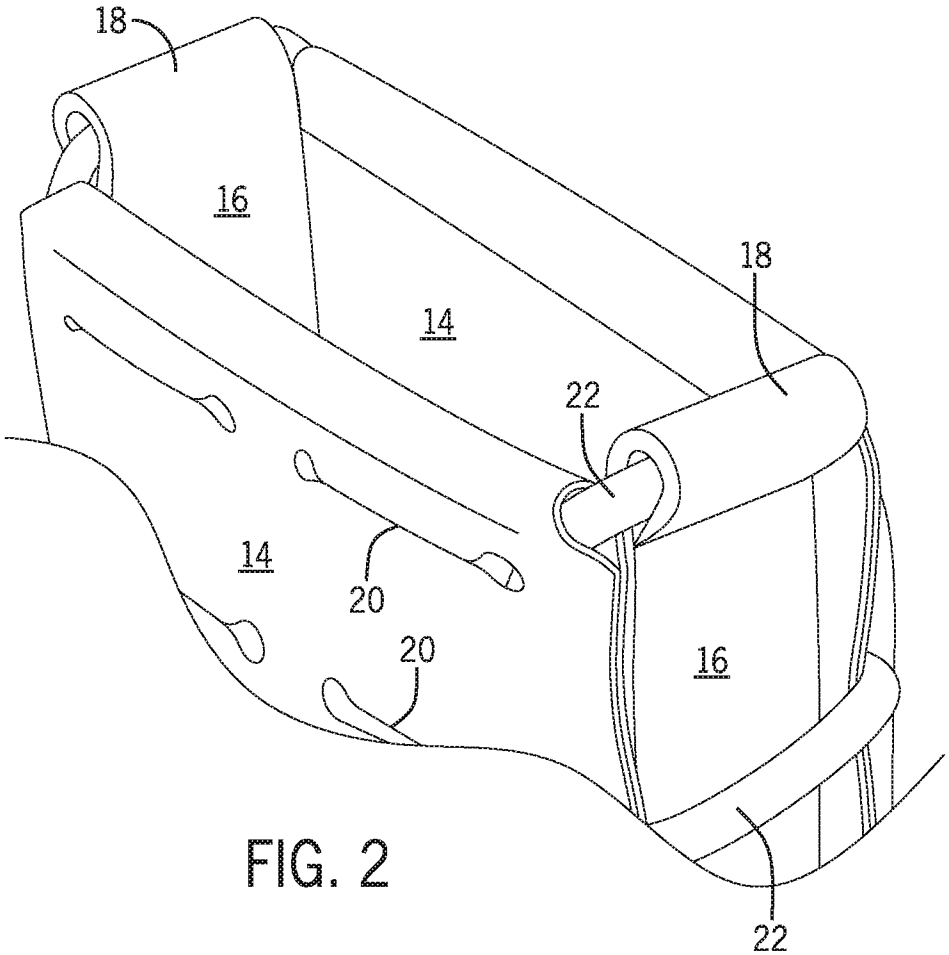
FIG. 2 is a detail perspective view of the tactical carrier without the magazine.
Figure 7:
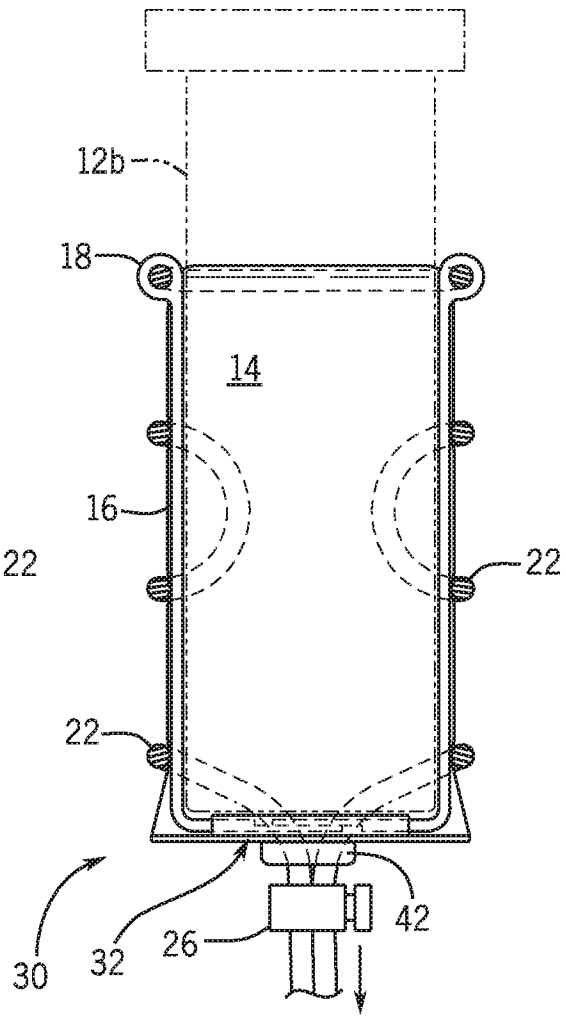
FIG. 7 is a cross-sectional view similar to FIG. 4 showing the tactical carrier in use with an alternate size magazine.
Figure 5:
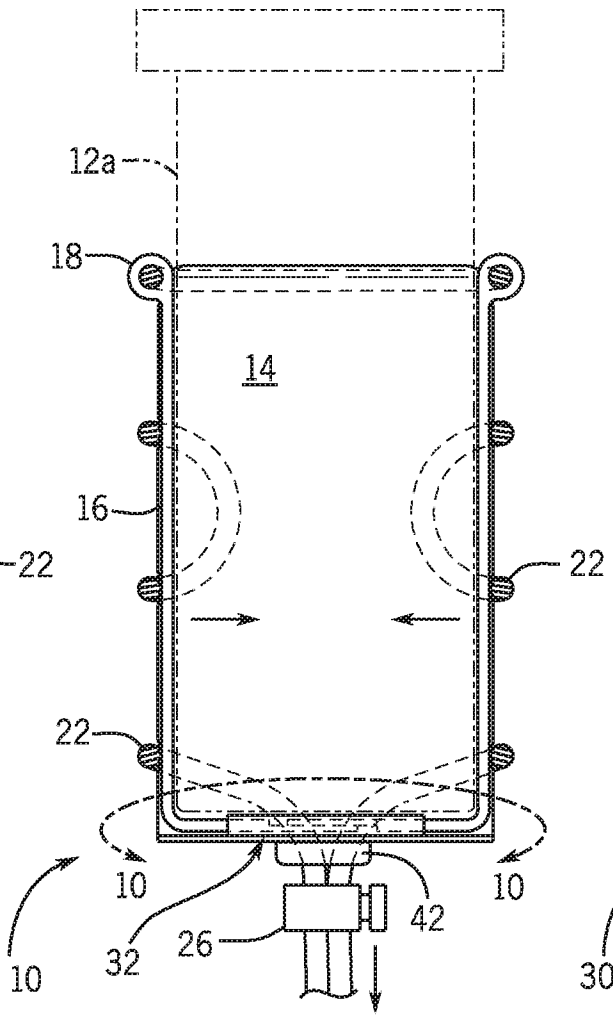
FIG. 5 is a cross-sectional view similar to FIG. 4 showing the tactical carrier in a second position.
Figure 4:
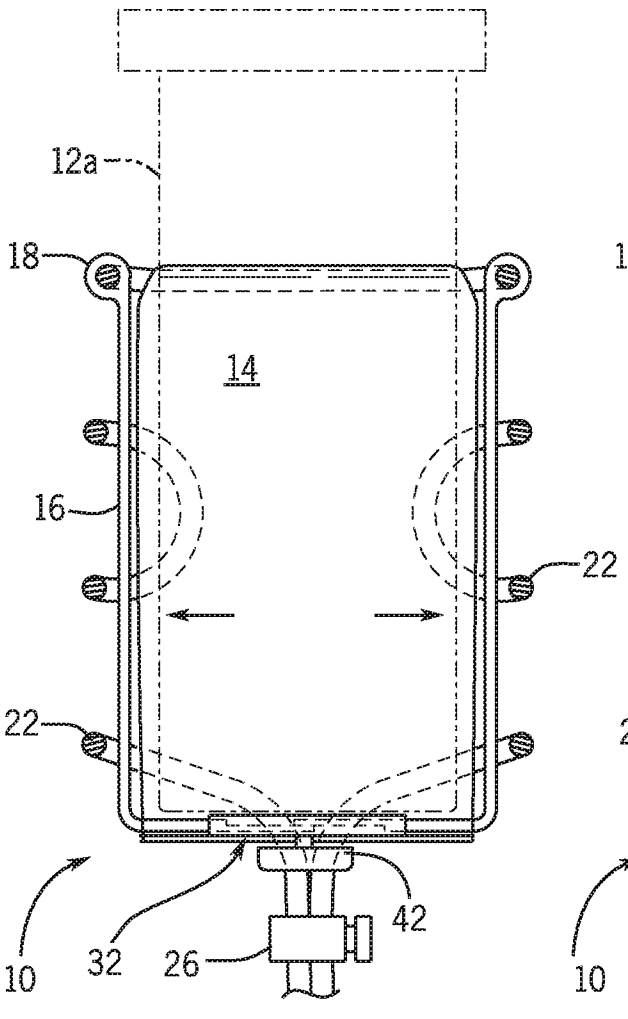
FIG. 4 is a cross-sectional view taken on line 4-4 of FIG. 3.
Figure 6:
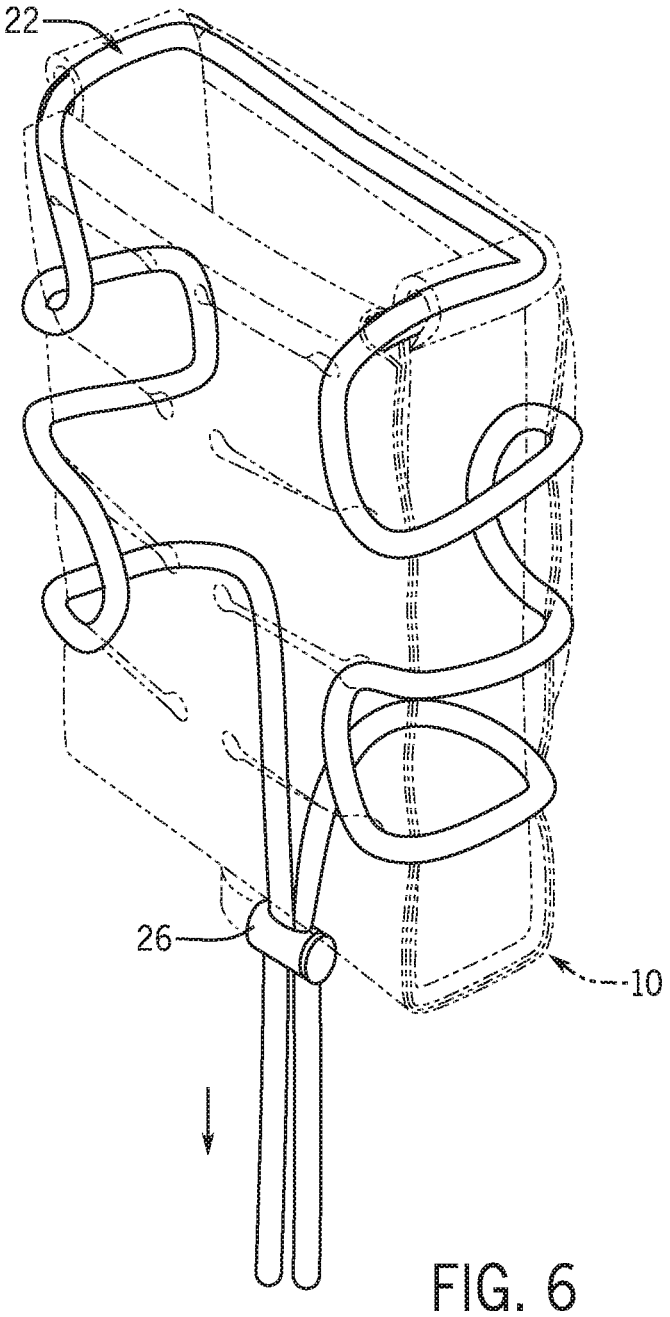
FIG. 6 is a perspective view of a cinch cord lacing with other elements shown in phantom.
Figure 9:
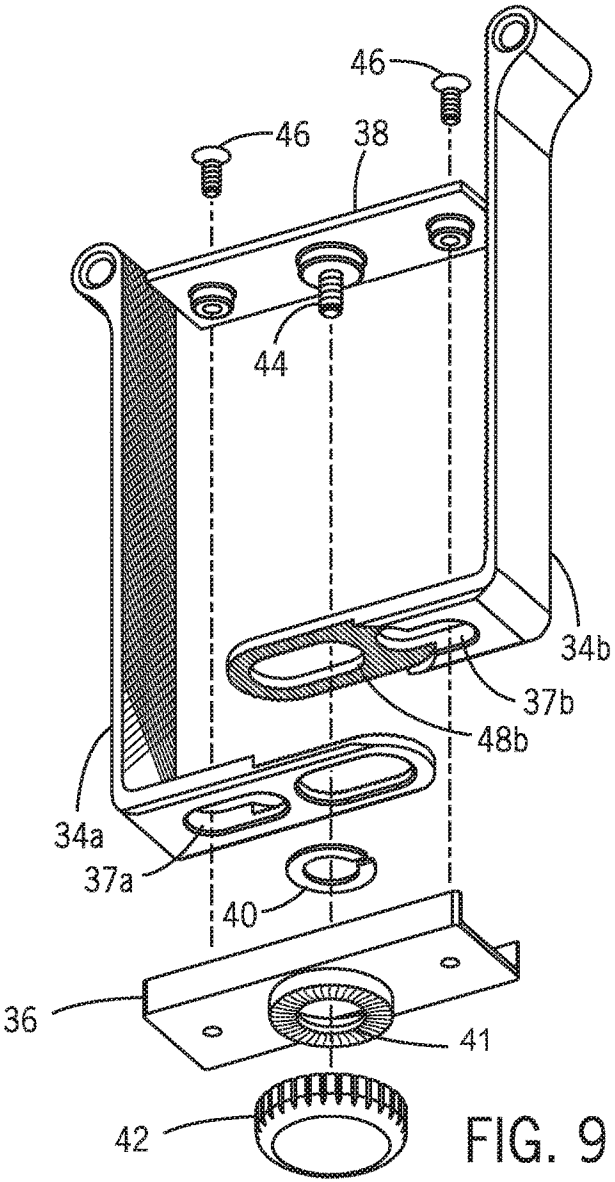
FIG. 9 is another exploded perspective view of the internal frame for the tactical carrier.
Figure 8:
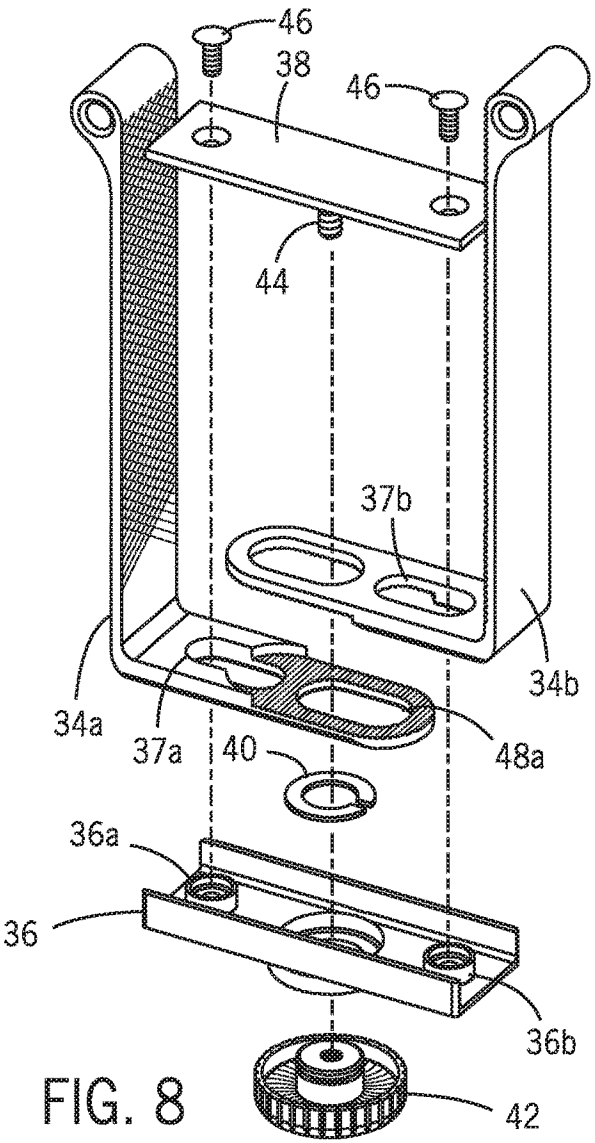
FIG. 8 is an exploded perspective view of an internal frame for the tactical carrier.
Figure 10:
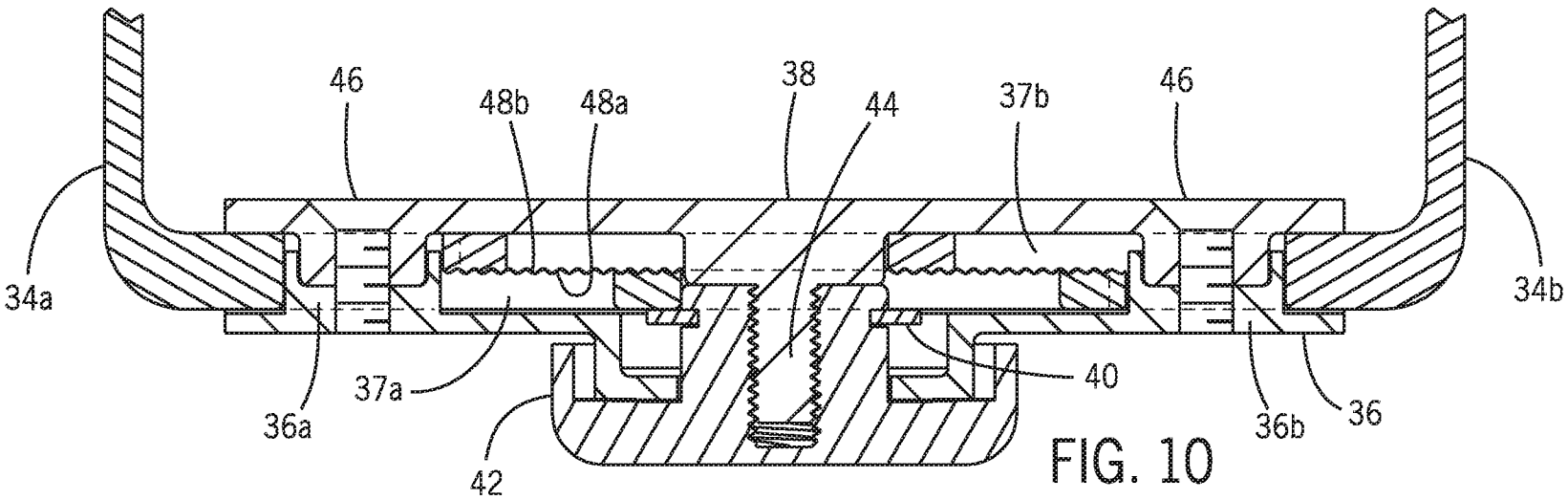
FIG. 10 is a cross-sectional view taken on line 4-4 of FIG. 3, showing the internal frame in a compressed position.
Figure 11:
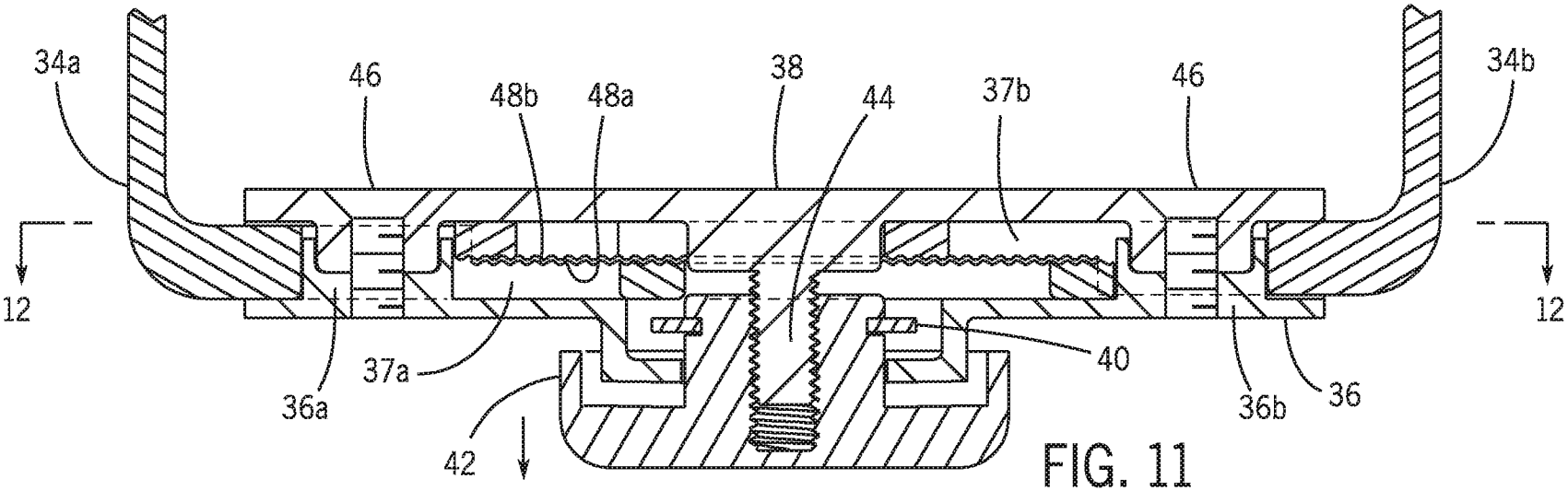
FIG. 11 is a cross-sectional view, similar to FIG. 10, showing the internal frame in an expanded position.
Figure 12:
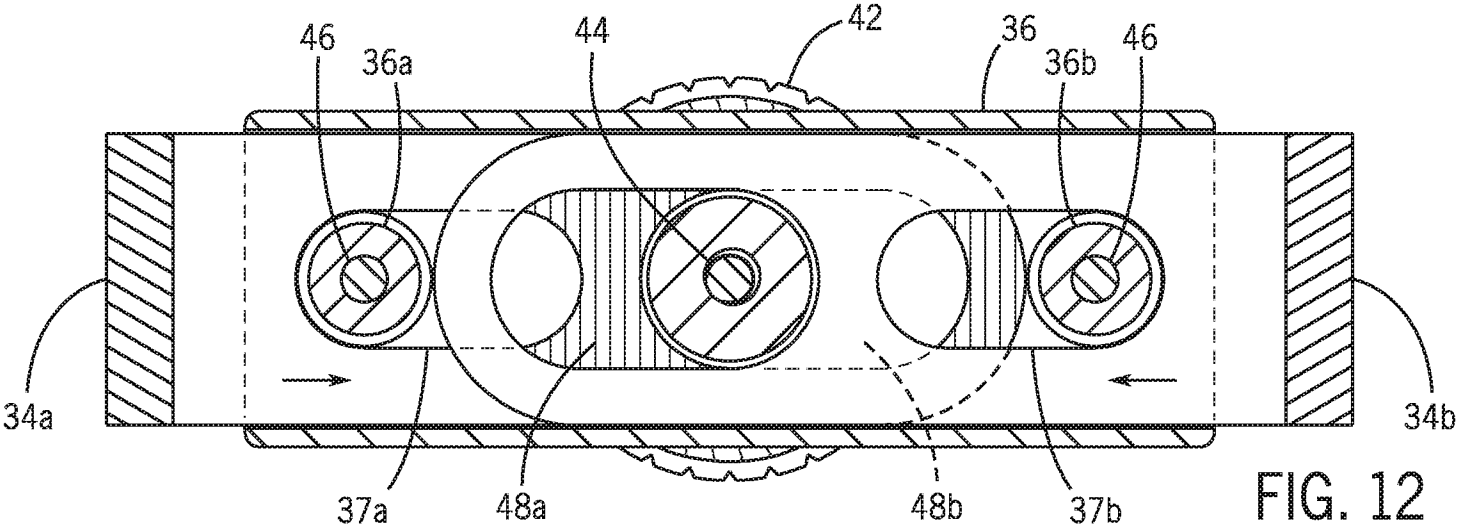
FIG. 12 is a top cross-sectional view taken on line 12-12 of FIG. 11 showing the compressed position of the internal frame.
Figure 13:
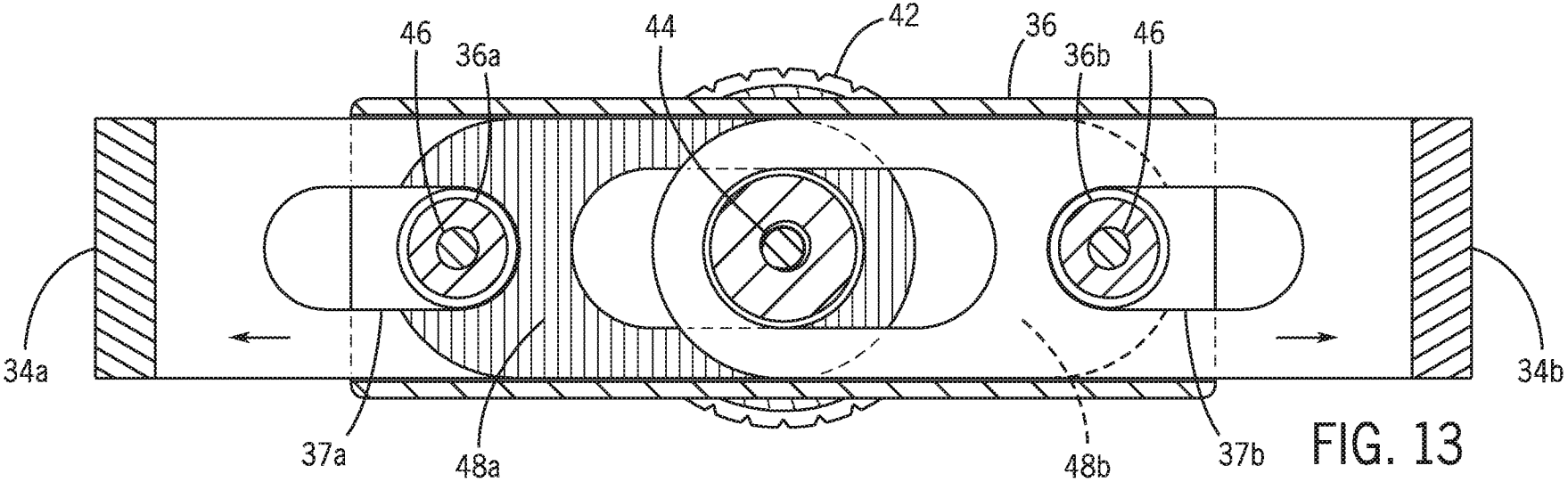
FIG. 13 is a cross-sectional view, similar to FIG. 12, showing the maximum expanded position of the internal frame.

As seen in reference to FIG. 2, a top end of the fabric pouch 14 may include a sleeve to receive the cinch cord 22 to permit adjustment of a top opening of the pouch. As seen in reference to FIGS. 3-7, representative lacing of the cinch cord 22 is depicted. A cinch clamp 26 receives free ends of the cinch cord 22 and is slidably adjustable along a length of the cinch cord 22 so that the cinch cord 22 can adjust to the dimensions of the tactical pouch 10 to the various tactical items carried therein. The cinch cord 22 may be formed from a parachute cord, such as 550 cord, or may be formed of an elastic cord material for resilient containment of the tactical items within the tactical carrier 10.

Components of the internal frame 16 are shown in reference to FIGS. 8-13. The internal frame 16 includes a first frame member 34*a* and a second frame member 34*b*, formed in a generally L-shape that are adjustably interconnected between a base plate 36 and a top plate 38. The base plate 36 and the top plate 38 A base element of the first frame member 34*a* and the second frame member 34*b* have each have a slotted guide aperture 37*a* and 37*b*, respectively. The slotted guide apertures 37*a* and 37*b* receive a fastener 46 that extends between the top plate 38 and the base plate 36.

The first frame member 34*a* and the second frame member 34*b* are selectively positionable between a compressed position and an extended position with the fasteners 46 carried within the respective slotted guide apertures 37*a* and 37*b*. A lock aperture 48*a* and 48*b* is provided in the first frame member 34*a* and 34*b*. A lock stud 44 is received through the locking apertures 48*a* and 48*b* and a lock bore 45 defined in the base plate 36. A lock knob 42 threadingly engages with the lock stud 44 to retain the base of the first frame member 34*a* and the second frame member 34*b* at a selected displacement between the compressed position and the extended position. A washer 40 may be disposed on the lock stud 44 to facilitate displacement of the first frame member 34*a* and the second frame member 34*b*. A base plate 36 has a first 36*a* and a second 36*b* guide apertures and an adjustment aperture 41 defined therein. The base elements have at least one adjustment.

Referring again to FIGS. 4-7, an adjustment sequence for adapting the tactical carrier 10 from the first sized magazine 12*a* to a second sized magazine 12*b* is shown. The lock knob 42 may be loosened on the lock stub 44. Then the internal frame 16 may be configured to a compressed condition by movement of the first frame member 34*a* and the second frame member 34*b* towards each other. When a desired dimensional spacing for the internal frame 16 is achieved to fit the second sized magazine 12*b*, the lock knob 42 may be tightened. The free ends of the cinch cord 22 may then be drawn through the cinch clamp 26 to draw the laced cinch cord 22 about the fabric pouch 14 and the internal frame 16. The cinch clamp 26 may then be positioned in abutment with the tactical carrier 10 to retain the cinch cord 22 in a tension about the tactical carrier 10.

The fabric pouch 14 may be dimensioned to the extents of the internal frame 16 when the internal frame 16 is configured in the fully extended position. With the internal frame 16 in the fully compressed position, excess material of the fabric pouch 14 may be drawn about the internal frame 16 to provide a snug fit about the tactical item that may be carried within the pouch.

As will be appreciated from the present disclosure, the tactical carrier 10 of the present invention provides for a single carrier that may be adapted to conform to a variety of tactical items having differing dimensional characteristics. With the tactical carrier 10 of the present invention that is adaptable to a variety of tactical items, the user can readily configure a tactical load with a unitary tactical carrier 10. Accordingly, there is no longer a need for the procurement and storage of multiple carriers of varying dimensions to outfit the tactical load.

It should be understood, of course, that the foregoing relates to exemplary embodiments of the invention and that modifications may be made without departing from the spirit and scope of the invention as set forth in the following claims.

What is claimed is:

1. An adjustable tactical carrier, comprising:

an internal frame defining a base and a sidewall of a carrier compartment, the internal frame adjustable between a compressed position and an extended position, and having an eye loop at a top end of the internal frame;

a fabric pouch dimensioned to at least partially surround the internal frame, the fabric pouch having a plurality of slots defined in a spaced apart relation about the fabric pouch; and a cinch cord laced through the eye loop and the plurality of slots, wherein the cinch cord may be tensioned to draw the fabric pouch in a close fitting relation with the internal frame.

2. The adjustable tactical carrier of claim 1, further comprising:

a cinch clamp receiving a free end of the cinch cord there through, the cinch clamp configured to retain the cinch cord in a selected tension.

3. The adjustable tactical carrier of claim 1, further comprising:

a first frame member and a second frame member, formed in a generally L-shape that are adjustably interconnected between a base plate and a top plate.

4. The adjustable tactical carrier of claim 3, further comprising:

a base element of each of the first frame member and the second frame member adjustably carried between a top plate and a base plate.

5. The adjustable tactical carrier of claim 4, further comprising:

a slotted guide aperture define in the base element of each of the first frame member and the second frame member;

a fastener extending through the slotted guide aperture and securing the top plate and the base plate.

6. The adjustable tactical carrier of claim 4, further comprising:

a lock bore defined in the base plate;

a lock aperture defined in the base element;

a lock stud extending through the lock bore and the lock aperture; and a lock knob adapted to threadingly engage the lock stud to retain the first frame member and the second frame member in a selected displacement between the compressed position and the extended position.

7. The adjustable tactical carrier of claim 1, wherein the plurality of slots are adapted to a Modular Lightweight Load-carrying Equipment (MOLLE) configuration.

8. An adjustable tactical carrier, comprising:

an internal frame defining a base and a sidewall of a carrier compartment, the internal frame adjustable between a compressed position and an extended position;

a fabric pouch dimensioned to at least partially surround the internal frame, the fabric pouch having a plurality of slots defined in a spaced apart relation about the fabric pouch; and a cinch cord laced through the plurality of slots, wherein the cinch cord may be tensioned to draw the fabric pouch in a close fitting relation with the internal frame in each of the compressed position and the extended position.

9. The adjustable tactical carrier of claim 8, further comprising:

a cinch clamp receiving a free end of the cinch cord there through, the cinch clamp configured to retain the cinch cord in a selected tension about the fabric pouch.

10. The adjustable tactical carrier of claim 9, further comprising:

a belt clip threadingly secured to the adjustable tactical carrier via the cinch cord.

11. The adjustable tactical carrier of claim 8, further comprising:

a first frame member and a second frame member are formed in a generally L-shape configuration that are adjustably interconnected between a base plate and a top plate.

12. The adjustable tactical carrier of claim 11, further comprising:

a base element of each of the first frame member and the second frame member is adjustably carried between the top plate and the base plate.

13. The adjustable tactical carrier of claim 12, further comprising:

a slotted guide aperture defined in the base element of one of the first frame member and the second frame member; and a fastener extending through the slotted guide aperture and securing the top plate and the base plate.

14. The adjustable tactical carrier of claim 12, further comprising:

a lock bore defined in the base plate;

a lock aperture defined in the base element;

a lock stud extending through the lock bore and the lock aperture; and a lock knob adapted to cooperatively engage the lock stud to retain the first frame member and the second frame member in a selected displacement between the compressed position and the extended position.

* * * * *